United States Patent [19]

Shetler

[11] 4,042,809

[45] Aug. 16, 1977

[54] SYSTEM FOR CONTROLLING TWO VARIABLES

[75] Inventor: Terry A. Shetler, Fort Collins, Colo.

[73] Assignee: Woodward Governor Company, Rockford, Ill.

[21] Appl. No.: 717,007

[22] Filed: Aug. 23, 1976

[51] Int. Cl.[2] ..... G05B 6/02

[52] U.S. Cl. ..... 235/150.1; 60/648; 60/663

[58] Field of Search ..... 60/648, 663; 235/150.1

[56] References Cited

FOREIGN PATENT DOCUMENTS

| | | | |
|---|---|---|---|
| 41,521 | 11/1974 | Japan | 235/150.1 |
| 38,207 | 10/1974 | Japan | 235/150.1 |

*Primary Examiner*—Eugene G. Botz

*Attorney, Agent, or Firm*—Leydig, Voit, Osann, Mayer & Holt Ltd.

[57] ABSTRACT

Improvements in a control system which maintains both the speed and the extraction pressure of an extraction type steam turbine at respective set point values by adjusting both the high pressure admission valve and the low pressure stage admission valve. Such systems are characterized by the fact that opening of the high pressure valve tends to increase both speed (for a given load) and extraction pressure (for a given extraction load); whereas opening of the low pressure valve tends to increase speed but decrease extraction pressure. The high pressure valve is positioned according to an additive function of speed and pressure errors; and the low pressure valve is positioned according to a subtractive function $f(E_s - E_p)$ of such errors. The improvement resides in bounding one error signal component which influences one of the valves to a value which, for any magnitude of the other error signal, corresponds to the saturation point or physical limit of the other valve. This avoids "fighting" of the two valves and large or long error transients when there are set point or load conditions which tend to drive the other valve beyond its maximum or minimum possible opening.

14 Claims, 5 Drawing Figures

SYSTEM FOR CONTROLLING TWO VARIABLES

BRIEF SUMMARY OF THE INVENTION

The present invention relates in general to closed loop systems wherein two variable conditions or parameters are simultaneously controlled to maintain them at respective set point values despite variations in loads or set points. More particularly, the invention relates to such systems in which two control elements are automatically adjusted to keep the two variables substantially at their set points—adjustment or changes in excitation of one control element directly affecting both variables in the same sense, and adjustment or changes in excitation of the other control element directly affecting one variable but oppositely affecting the other variable.

As will be noted below with regard to an exemplary embodiment, the invention will find advantageous, but not exclusive, use in controlling extraction type steam turbines where the speed or load of a driven device is controlled, while the pressure of extraction steam is also controlled.

It is the general aim of the invention to improve the performance of control systems of the foregoing type; and more specifically to alleviate or eliminate the long or large error transients which may occur due to saturation of one control element causing an undue influence on the other control element.

It is another object of the invention to achieve such alleviation or elimination of permanent or transient errors in one controlled variable even when conditions are such that the other controlled variable is beyond precise control because a control element is limited or saturated.

In carrying out the invention, the two control elements are controllably excited or adjusted by two respective command signals, the first being an additive function of two error function signals which vary according to the departures of the respective controlled variables from their set points, and the second being a subtractive function of such error function signals. To prevent "fighting" of the two control elements, means are provided to impose a boundary threshold on an error function signal used to create one of the command signals whenever the other control signal tends to exceed a value which would drive its control element to a saturation or limit status. The boundary threshold value is not, however, fixed; on the contrary, the means for imposing the boundary make the threshold value change as a function of the other error function signal.

DESCRIPTION OF THE DRAWINGS

The manner in which these objectives are obtained, and the organization of the apparatus for carrying out the invention, will become clear as the following description of exemplary embodiments proceeds, with reference to the accompanying drawings, in which.

While the invention has been shown and will be described in some detail with reference to specific, exemplary embodiments, there is no intention that it thus be limited to such detail. On the contrary, it is intended here to cover all modifications, alternatives and equivalents falling within the scope of the invention as defined by the appended claims.

DETAILED DESCRIPTION

Figure 1:
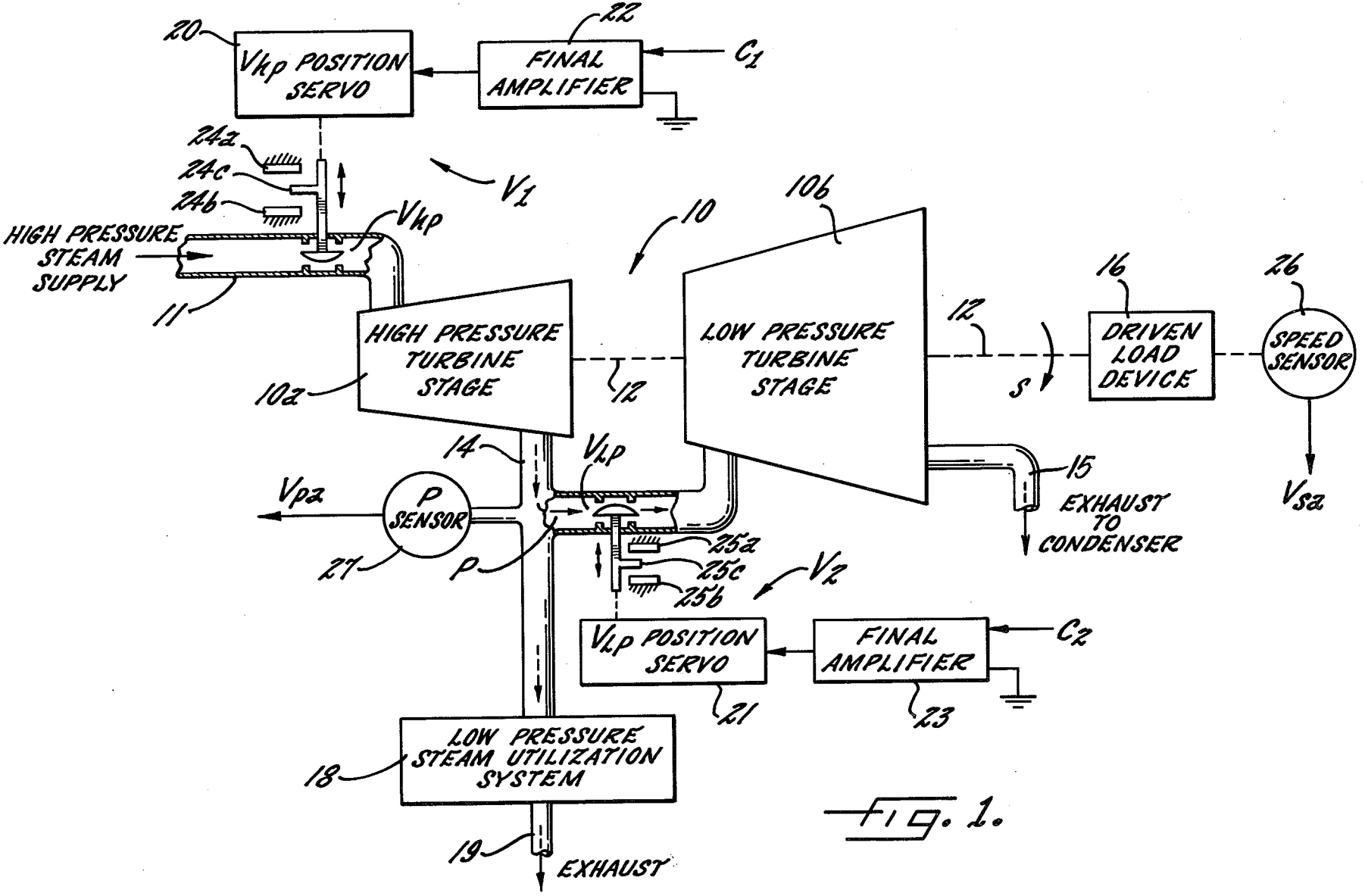
FIG. 1 is a diagrammatic illustration of an extraction steam turbine associated with two control elements for jointly and simultaneously controlling turbine speed and extraction pressure.

Referring to FIG. 1, a two-stage extraction steam turbine 10 is shown as having high and low pressure stages 10*a* and 10*b*. Super-heated high pressure steam is supplied from a source 11 through a high pressure control valve $V_{hp}$ to the high pressure stage 10*a* where it exerts work on the common output shaft 12 and exits via a conduit 14 at a reduced pressure and temperature. Such steam is then passed through a low pressure control valve $V_{Lp}$ into the low pressure stage 10*b* where it exerts further work to rotate the output shaft 12 and then exits via a conduit 15 to a condenser (not shown). The high and low pressure stages thus both act on the common shaft 12 to rotate a driven mechanical load device 16. The shaft and the load turn at a speed S which is determined not only by the rate of energy input, i.e., rate of steam flow, to the turbine stages but also by the load torque of the device 16. As the rate of steam flow through the turbine stages 10*a* and 10*b* increases or decreases, or as the torque of the load device 16 decreases or increases, the speed S will go up or down. The speed will, of course, come to a steady state or equilibrium value when the mechanical power of the turbine exerted on the shaft 12 equals the mechanical power consumed by rotational driving of the load 16.

In many industrial plant installations, steam is generated efficiently in a high pressure boiler and superheated to have both high pressure and temperature. That steam is intended primarily for use in the turbine 10 for controlled drive of the load device 16 which may be, for example, an electrical alternator supplying electrical power to a plant distributing system. Beyond that, however, the industrial plant may also require steam at a relatively lower pressure and temperature for auxiliary utilization. For example, low pressure steam may be needed to supply heat to buildings or to various chemical treatment vats. The turbine high pressure stage 10*a* is thus used not only as a device for obtaining useful mechanical work from the efficiently-produced high pressure steam of source 11, but also as a conveniently available pressure reducer, inasmuch as the output pressure P in the conduit 14 is low enough for direct application to a low pressure steam utilization system 18 (for example, a building heating array made up of a plurality of room heat exchange units or a chemical vat heating array made up of a network of heat exchangers).

As is evident from FIG. 1, the steam at low pressure P exiting from turbine stage 10*a* divides so that one part passes through the valve $V_{Lp}$ to be fed through the low pressure stage 10b, and one part passes directly into the auxiliary steam utilization system 18. For a given value of the pressure P, the division of steam depends upon the relative resistances to flow presented by the valve $V_{Lp}$ and the auxiliary system 18. The latter resistance (or "steam drain load") of course depends upon the number of heat exchange units in use within the system 18 and the total area of the conduits and control valves which they create in conducting steam to a final exhaust or return conduit 19. The "drain" of steam through the auxiliary system 18 is thus an independent variable, but in order to have some meaningful control on heat transfer within the units of the system 18, it is desired to control the pressure P such that it remains essentially constant at a selected, but adjustable, set point value.

Likewise, the load torque imposed upon the turbine shaft 12 by the device 16 is an independent variable which may from time to time change. In many installations, it is desired to control the turbine 10 such that the speed S remains constant at a selected, but adjustable, set point value. For example, in the case where the load 16 is an electrical alternator whose generated voltage is to be held at a constant frequency (e.g., 60 Hz.) despite changes in the current drawn into the associated distribution system, it is necessary to change the rate of steam flow through the turbine as various electrical devices are turned on or off in different combinations.

Given the fact that the torque of load 16 and the "steam drain load" of the auxiliary system 18 may vary in unforeseen fashions, and yet given the objective of controlling both speed S and pressure P at respective set point values, the following relationships may be observed:

1. For a given torque imposed by load 16 and a given "steam drain load" created by the system 18, turbine speed S will increase or decrease as the high pressure valve $V_{hp}$ is opened or closed—since this increases or decreases the rate of steam flow through both turbine stages 10a, 10b.
2. For the same given loads, turbine speed S will also increase or decrease as the valve $V_{Lp}$ opens or closes, since this increases or decreases the rate of steam flow through the low pressure stage 10b and the latter's power contribution applied to the shaft 12.
3. For the same given loads, if the valve $V_{hp}$ is opened or closed, the pressure P will increase or decrease.
4. But for the same given loads, if the valve $V_{Lp}$ is opened or closed, the pressure P will decrease or increase.
5. If other factors remain constant and the torque imposed on shaft 12 by load 16 increases or decreases, then turbine speed S will decrease or increase.
6. If other factors remain constant, as the steam drain load (ease of steam flow) of the system 18 increase or decreases then the pressure P will decrease or increase.

As will be explained more fully below, the valves $V_{hp}$ and $V_{Lp}$ are both variably adjusted in order to control both of the two variables S and P at desired, adjustable set point values. Typically in actual practice, these valves are adjusted by well known closed loop positioning servos 20 and 21, each receiving an electrical input signal from its associated final amplifier 22 or 23. The valve $V_{hp}$ with its position servo 20 and final amplifier 22 are here conveniently designated as a final "control element" $V_1$ which is responsive to an input command signal $C_1$. The position of the valve $V_{hp}$ (i.e., the degree to which it is opened), is proportional to the magnitude of the command signal $C_1$. Yet, it is to be observed that one or more of the components which make up the control element $V_1$ is (in essentially all actual practical applications) limited or saturable in the response which it can make to the command signal $C_1$. This is illustrated in FIG. 1 by physical stops 24a and 24b engageable by a projection 24c movable with the stem of the valve $V_{hp}$. As the signal $C_1$ takes on and exceeds a certain upper value $C_{1u}$, the valve $V_{hp}$ can open no wider than some maximum limit position which is here illustrated as established by the stop 24a. On the other hand, as the compound signal $C_1$ reaches and falls below a certain value $C_{1L}$, the valve $V_{hp}$ can close no further than the minimum position established by the stop 24b. Thus, the final control element $V_1$ is here shown characteristically as one which reaches a limit or saturated condition when the command signal $C_1$ applied thereto rises above or falls below certain predetermined upper and lower values.

In a similar fashion, the valve $V_{Lp}$, its position servo 21 and its final amplifier 23 are here collectively designated as a final control element $V_2$ responsive to a command signal voltage $C_2$. As the voltage $C_2$ varies over a given range, the plunger of the valve $V_{Lp}$ is proportionally positioned in an opening direction. Yet, when the command signal $C_2$ reaches and varies beyond predetermined upper or lower values $C_{2u}$ or $C_{2L}$, stops 25a and 25b cooperating with a projection 25c prevent the valve from moving beyond a maximum opening position or a minimum opening position. It will be understood as the following description proceeds that the final control elements $V_1$ and $V_2$ possess that characteristic so commonly found, namely, that they produce a generally proportional (but not necessarily purely linear) response in supplying an energy medium to some device which affects a controlled variable but that they reach limits or saturation (either physically or electrically) in their responses when command signals fed thereto vary beyond predetermined upper or lower values.

Moreover, the control elements $V_1$, $V_2$ (here including valves for controlling the flow of energy medium such as steam) are intended to represent generically any one of a wide variety of final control elements which may be employed in systems for controlling variables other than speed or pressure. For example, if one of the controlled variables in a different type of system were the temperature within an electric furnace, then the final control element might be a saturable reactor in series between an ac. voltage source and the furnace heating elements, with the dc. winding of the reactor variably excited by a command signal to modulate the supply of electrical energy to the heating elements. In that case, the excitation command signal to the dc. winding of a saturable reactor produces a generally inversely proportional variation in the impedance of the main reactor windings; but as the dc. signal reaches and exceeds predetermined upper and lower values, then that relationship of proportionality no longer exists, and further excursions of the command signal do not materially change the rate of admission of electrical energy to the controlled element.

The apparatus of FIG. 1 further includes appropriate transducers for producing signals representing the actual values of the controlled variables S and P. Such transducers may take any of many well known forms. The first is here shown as a dc. tachometer 26 driven by shaft 12 and producing a voltage $V_{sa}$ which is proportional to the actual value of the speed S. The second is a pressure sensor 27 (for example, a bellows actuated potentiometer) coupled into the conduit 14 which produces a dc. voltage $V_{pa}$ proportional to the actual value of the pressure P. These signals are utilized in the conventional, prior art circuits of FIG. 2, to which attention is next directed.

To produce a signal representing the desired or set point value for speed S, a potentiometer 30 excited from an appropriate B+ source voltage has an adjustable wiper upon which a variable set point voltage $V_{ss}$ appears. Its magnitude depends upon the adjusted position of that wiper and may be changed from time to time by a human operator. Likewise, a potentiometer 31 creates on its wiper an adjustable voltage $V_{ps}$ representing the desired or set point value for the pressure P. The voltages $V_{sa}$ and $V_{pa}$, as they appear in FIG. 1 and which represent the actual values of speed S and pressure P, are also shown as inputs to the control circuitry in FIG. 2. That circuitry is intended to keep the speed S and pressure P at their set point values by appropriately changing the command signals $C_1$ and $C_2$ as may be necessary to maintain the speed error ($V_{ss} - V_{sa}$) and the pressure error ($V_{ps} - V_{pa}$) substantially at zero—as either of the set points is changed or as either of the loads (the torque imposed by load 16 or the steam bath of system 18) changes.

Recalling that the final control elements $V_1$ and $V_2$ are actuators which response proportionally (except when saturated) to the command signals $C_1$ and $C_2$, the control system includes speed error and pressure error channels 32 and 33 formed by amplifiers $A_1$ and $A_2$ which, for stability, are constructed to provide proportional-integral-derivative (PID) action. Such amplifiers are per se well known in the art. Briefly, the speed error channel is formed by a high open-loop gain operational amplifier $A_1$ receiving the actual and set point speed voltages $V_{sa}$ and $V_{ss}$ through input resistors $R_{1a}$ and $R_{1b}$ leading to its inverting and non-inverting input terminals. The amplifier receives B+ and B− supply voltages in conventional fashion. Its output voltage $E_s$ is returned via a negative feedback path to the inverting input—such path including a potentiometer 34 leading to ground and having an adjustable wiper 35 connected via a capacitor 36 and a resistor 37 to the inverting input terminal. The active portion of the potentiometer 34 between its wiper 35 and ground is paralleled by a capacitor 38.

The amplifier $A_1$ with that feedback circuit provides PID action in well known fashion. The effective direct net input signal is the speed error ($V_{ss} - V_{sa}$) at any instant. The output voltage $E_s$ is a function of that error, with the differentiating action of the capacitor 36 in the feedback path introducing an integrating characteristic into the overall transfer function; the series resistor 37 determining the magnitude of the proportional term in such transfer function; and the capacitor 38 (which acts as an integrator in the feedback path) producing a derivative or lead term in the transfer function. Adjustment of the wiper 35 determines the overall gain for the transfer function. Therefore, it may be said that the output voltage $E_s$, which may swing either positive or negative in polarity, is a "speed error function signal" which in the present case varies with PID response to the speed error ($V_{ss} - V_{sa}$), i.e., the difference between set point speed and actual speed.

Similarly, the pressure error channel includes the amplifier $A_2$ with a substantially identical feedback path differing only in the specific values chosen for the capacitors, resistor and wiper setting. Receiving the voltages $V_{pa}$ and $V_{ps}$ via input resistors $R_2$ and $R_{2b}$, the amplifier $A_2$ produces an output voltage $E_p$ which varies as a PID function of the difference between the set point pressure and the actual pressure value, i.e., ($V_{ps}$ − Vhd pa). Merely for simplicity in the drawings none of the operational amplifiers (excepting $A_1$) is shown with the B+ and B− supply connections thereto. These are to be implied.

Because the integral term in the responses of amplifiers $A_1$ and $A_2$, the speed error and pressure error function voltages $E_s$ and $E_p$ will in the action of the overall system change until the respective speed and pressure errors are essentially zero, and then hold at steady state values other than zero. Under such steady state conditions, the command signals $C_1$ and $C_2$ will take on values which excite the control elements $V_1$ and $V_2$ (to hold the valves $V_{hp}$ and $V_{Lp}$ in corresponding positions) necessary to keep the errors at zero. For brevity hereafter, however, the signals $E_s$ and $E_p$ will be called simply the "speed error voltage" and the "pressure error voltage" although they respectively vary as PID functions of speed error and pressure error and are not necessarily of zero value when the respective errors are zero.

In order to excite the first control element $V_1$ with a properly adjusted command signal $C_1$, the speed error voltage $E_s$ is fed to a non-inverting summing amplifier 40 made up of a first inverting operational amplifier $A_3$ and a subsequent single input inverter 41 (which may be an operational amplifier having unity gain). The voltage $E_s$ is applied via an input resistor $R_{3a}$ while (i) a fraction $K_2 E_p$ of the pressure error voltage $E_p$ is picked off of an adjustable potentiometer 42 and applied through an input resistor $R_{3b}$, and (ii) a constant (but adjustable) offset voltage $K_3$ is picked off of a potentiometer 44 (excited from a B+ source) and fed through an input resistor $R_{3c}$. All such resistors lead to the inverting input of the amplifier $A_3$ which has a feedback resistor $R_{3f}$. The output of amplifier $A_3$ is the inverted sum of its three inputs, so that the output $C_1$ from the inverter 41 varies as the non-inverted sum of the three inputs.

Although various choices may be made to achieve the same result, let it be assumed that the resistors are chosen in size such that:

$$\frac{R_{3f}}{R_{3a}} = K_1; \frac{R_{3f}}{R_{3b}} = 1; \frac{R_{3f}}{R_{3c}} = 1 \qquad (1)$$

As will be apparent to one skilled in the art, the command signal $C_1$ will therefore vary as an additive function of the three input voltages:

$$C_1 = K_1 E_s + K_2 E_p + K_3 \qquad (2)$$

where $K_1$ is a proportionality constant selected by choosing the ratio of values for resistors $R_{3f}$ and $R_{3a}$; $K_2$ is a proportionality constant chosen by setting the wiper of potentiometer 42 to pick off a desired fraction of the voltage $E_p$; and $K_3$ is a constant chosen by setting the wiper of potentiometer 44.

Recalling that the control element $V_1$ directly affects both the first and second controlled variables S and P (by increasing or decreasing both such variables when the valve $V_{hp}$ opens or closes), the command signal $C_1$ which excites the element $V_1$ tends to increase when either the speed error signal $E_s$ or the pressure error signal $E_p$ increases. The ratio of the influence of the speed error voltage and the pressure error voltage upon the command signal $C_1$ and the control element $V_1$ is determined by setting the potentiometer 42 to establish the constant $K_2$. It becomes apparent, therefore, that the command signal $C_1$ which directly affects both the controlled variables is generally an additive function of the two sensed errors, and this may be expressed:

$$C_1 = f(E_s + E_p) \quad (3)$$

The command signal $C_2$, by contrast, is created at the output of an algebraic summing amplifier 45 made up of an operational amplifier $A_4$ which performs a subtractive function. Such amplifier receives (i) the pressure error voltage $E_p$ via a input resistor $R_{4a}$ leading to the inverting input; (ii) a second input voltage $K_4 E_s$ picked off of an adjustable potentiometer 46 (energized with the signal $E_s$) and fed via an inverter 47 and an input resistor $R_{4b}$ to the inverting input terminal; and (iii) a voltage $-K_6$ picked off of a potentiometer 48 (excited from a B-source) and fed through an input resistor $R_{4c}$ to the inverting input terminal. The amplifier $A_4$ has a feedback resistor $R_{4f}$.

Let it be assumed that the resistors associated with the amplifier $A_4$ have the following value relations:

$$\frac{R_{4f}}{R_{4a}} = K_5; \frac{R_{4f}}{R_{4b}} = 1; \frac{R_{4f}}{R_{4c}} = 1 \quad (4)$$

It will be seen that by adjusting the resistor $R_{4a}$ the proportionality factor $K_5$ associated with the input signal $E_p$ may be given any desired value. Similarly, the value of the proportionality factor $K_4$ may be established by adjustment of potentiometer 46, and the value of the fixed input voltage $K_6$ may be selected by adjusting the potentiometer 48. Recalling that the output of inverter 47 is $-K_4 E_s$ and that the voltage from potentiometer 48 is $-K_6$, then in accordance with the well known operation of algebraic summing operational amplifiers, the second command signal $C_2$ will vary from instant to instant according to the relationship:

$$C_2 = K_4 E_s - K_5 E_p + K_6 \quad (5)$$

From Equation (5), when the pressure error voltage $E_p$ increases or decreases, the command signal $C_2$ decreases or increases, respectively. This is the correct control action because as the pressure P tends to decrease below the set point value, it is necessary for the valve $V_{LP}$ (FIG. 1) to close in order to eliminate the pressure error. This happens because when the actual pressure signal $V_{pa}$ decreases, the pressure error function voltage $E_p$ increases and the output from amplifier $A_4$ forming the command signal $C_2$ decreases. When the command signal $C_2$ decreases, the control element $V_2$ exerts an influence to increase the actual pressure P, i.e., the valve $V_{Lp}$ is moved more toward its closed position. It is therefore to be observed that in the control apparatus of FIG. 2, the second command signal $C_2$ varies as a subtractive function of the two error signals $E_s$ and $E_p$; and this may be generally expressed:

$$C_2 = f(E_s - E_p) \quad (6)$$

Figure 2:
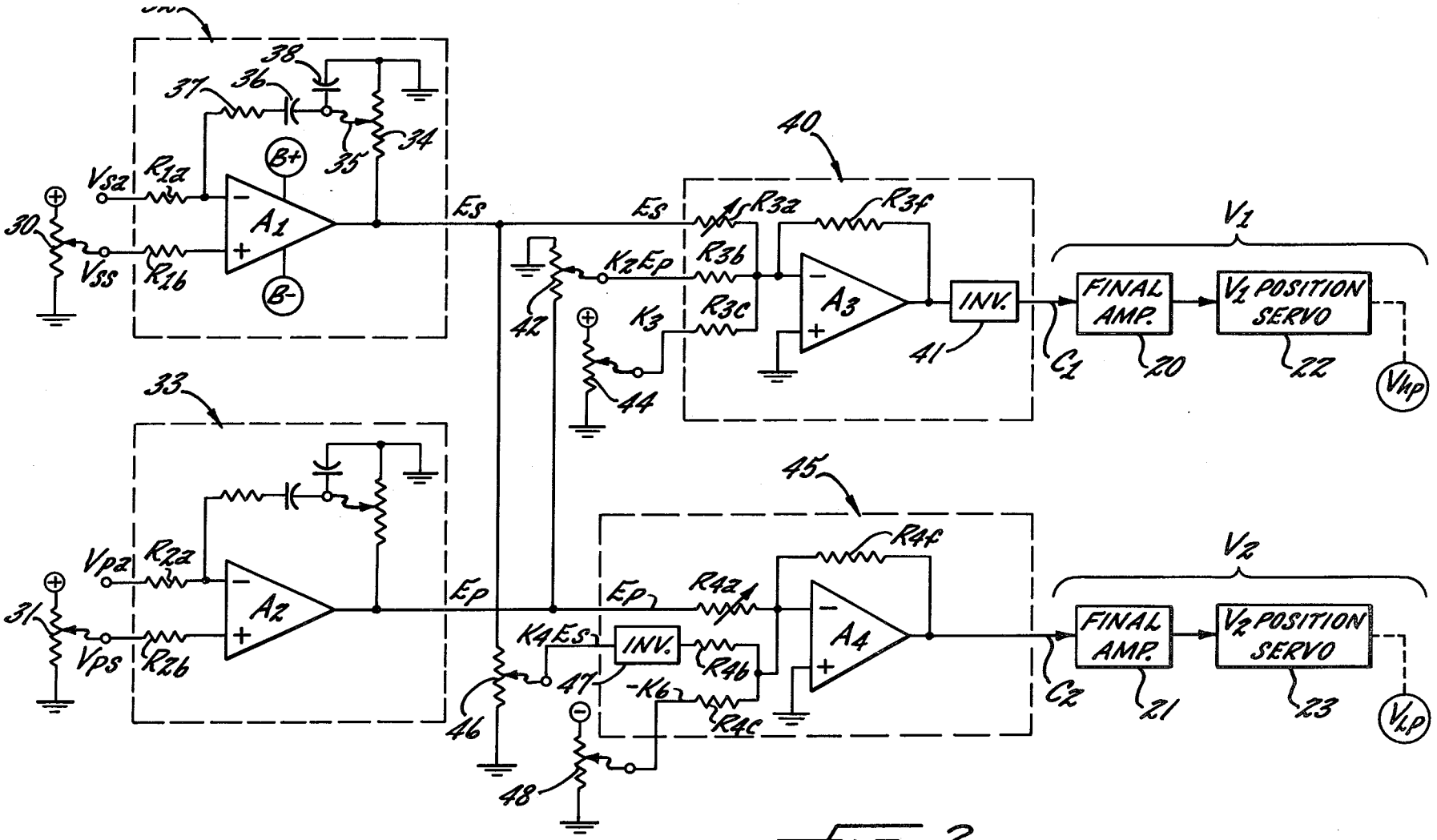
FIG. 2. (PRIOR ART)
FIG. 2 is a block diagram of a representative prior art control system employed to variably excite or adjust the two control elements of the extraction steam turbine shown in FIG. 1.

In summary, the arrangement of FIGS. 1 and 2 is one where two variables S and P are simultaneously controlled. They are directly affected by a control element $V_1$ excited to act directly in response to a command signal $C_1$ which varies as an additive function of the two errors between the set point and actual values of the two variables. On the other hand, one of the variables S is directly affected by the other control element $V_2$, and the other variable P is oppositely affected by that control element $V_2$. The second control element $V_2$ is excited to act directly in response to a command signal $C_2$ which varies as a subtractive function of the two errors.

Each control element $V_1$ and $V_2$ is influenced by both error function signals, as will be apparent from the cross coupling of the signal $E_p$ into the amplifier $A_3$ (via potentiometer 42), and the cross coupling of the signal $E_s$ into the amplifier $A_4$ (via potentiometer 48). Thus:

a. When speed S tends to fall below its set point and $E_s$ increases, the signals $C_1$ and $C_2$ both increase and the valves $V_{hp}$ and $V_{Lp}$ both open to increase the rates of steam flow through both turbine stages 10*a* and 10*b*. Both stages therefore tend to increase speed back to the set point. This happens either if the torque imposed by the load 16 increases or if the set point voltage $V_{ss}$ is increased.

b. When presssure P tends to fall below its set point and $E_p$ increases (even if this happens due to the action described immediately above by which valve $V_{Lp}$ opens), the signal $C_1$ increases but the signal $C_2$ decreases — so that valve $V_{hp}$ tends to open and valve $V_{Lp}$ tends to close. Both such actions tend to increase pressure P back to the original set point. This operation occurs either when the "steam drain load" of the system 18 increases or when the set point voltage $V_{ps}$ is increased.

Of course, when speed S or pressure P tends to rise above its respective set point, then the resultant corrective action is in a sense opposite to that described at (*a*) and (*b*) above.

Any disturbance will usually cause readjustment of both control elements $V_1$ and $V_2$ until the command signals $C_1$ and $C_2$ arrive at values which restore both speed and pressure substantially to their set point values. Because the influence of control element $V_2$ on speed is not as great as that of control element $V_1$, but is greater on pressure than that of $V_1$, the respective signals $K_2 E_p$ and $K_4 E_s$ fed to combining amplifiers $A_3$ and $A_4$ are made to have adjusted ratios or fractions of the primary error signals $E_p$ and $E_s$. This is the purpose of the potentiometers 42 and 48. By adjusting the preselected value of the ratio factors $K_2$ and $K_4$ until satisfactory balanced action is obtained simultaneous and reasonably precise, rapid control of the two variables S and P is achieved.

As noted above, the extraction steam turbine control system of FIGS. 1 and 2 is typical of many different two-variable systems to which the improvement of the present invention may be applied. To bring the generic relationships clearly to mind, the following table will be helpful.

| Generic to Various Systems | The specific Example Here Described |
|---|---|
| First and second variables are controlled. | S and P are controlled. |
| Two control elements $V_1$ and $V_2$ are employed to exert influences on the both variables. | S is influenced by both $V_{hp}$ (in $V_1$) and $V_{LP}$ (in $V_2$); P is also influenced by both $V_{hp}$ (in $V_1$) and $V_{Lp}$ (in $V_2$). |
| One control element directly influences both controlled variables. | When $V_{hp}$ opens more, both S and P tend to increase. |
| The other control element | When $V_{Lp}$ open more, S tends |

-continued

| Generic to Various Systems | The specific Example Here Described |
|---|---|
| directly influences one variable and oppositely influences the other variable. | to increase and P tends to decrease. |
| One control element is excited by a first command signal which varies as an additive function of both variable errors. | $V_{hp}$ is opened according to command signal $C_1$, where $C_1 = f(E_s + E_p)$ |
| The other control element is excited by a second command signal which varies as a subtractive function of both variable errors. | $V_{Lp}$ is opened according to command signal $C_2$, where $C_2 = f(E_s - E_p)$. |
| At least one control element saturates or physically limits when its command signal varies beyond a certain level. | If signal $C_2$ increases beyond a known saturation point value $C_{2u}$, the valve $V_{Lp}$ hits stop 25b, and the valve cannot open further. (Or, if $C_2$ decreases below a known saturation level $C_{2L}$, valve $V_{Lp}$ hits stop 25a.) |

I have discovered that when one control element saturates or limits because of a very large error for one controlled variable, an unduly severe transient is introduced in the other controlled variable even though the latter at that point in time has essentially zero error. Consider the conditions which may arise if the steam drain load (FIGS. 1 and 2) were suddenly and drastically decreased, whereupon the pressure P would rise greatly above its set point value — and the error signal $E_p$ would greatly decrease (i.e., become a very small positive or indeed a relatively large negative value). As indicated by Equation (5), the signal $C_2$ would increase to some very high value in an attempt to open valve $V_{Lp}$ beyond its physical maximum opening. Indeed, the valve would hit its saturation or maximum opening stop **25*b*. With the signal $E_p$ at a very low value, the signal $K_2 E_p$ fed to the combining amplifier $A_3$ would fall below any region which corresponds to control action by the valve $V_{LP}$. Thus, the signal $C_1$ (see Equation 2**) would decrease to a great extent (even though no speed error existed), thereby causing value $V_{hp}$ in element $V_1$ to close. Such closure of $V_{hp}$ would helpfully tend to reduce the pressure P — but it would also reduce the speed S by a wide margin below its set point. The closure of valve $V_{hp}$ therefore would introduce a large and long speed error transient. Speed would go widely "off set point" because of the large pressure error and the inability of the valve $V_{Lp}$ to respond beyond its saturation limit. Ultimately the closure of the valve $V_{hp}$ would decrease pressure P to increase the signal $E_p$ (e.g., to make the latter less negative) thereby to decrease the command signal $C_2$; and the signal $C_1$ would increase again to restore speed to set point value. But there would have been an undesirably large or long speed error transient caused solely by a substantial pressure error which made the signal $E_p$ go beyond the saturation or limit point of the control element $V_2$.

The same sorts of severe transients will arise, of course, if the pressure set point $V_{ps}$ is suddenly reduced to an extremely low value. The signal $E_p$ would decrease well beyond a value causing the signal $C_2$ to drive valve $V_{Lp}$ to its saturation or maximum opening limit; the drastic decrease in the signal $K_2 E_p$ would reduce the signal $C_1$ and cause valve $V_{hp}$ to close so much as to create a serious speed error transient.

On the other hand, if the steam drain load were suddenly and drastically increased to make the pressure P fall greatly below its set point (or if the set point signal $V_{ps}$ were suddenly increased drastically) the error signal $E_p$ would increase markedly, the signal $C_2$ would fall, valve $V_{Lp}$ would try to close fully but would be unable to move beyond its minimum opening stop **25*a*** — and the signal $K_2 E_p$ would increase so much as to increase $C_1$ and open valve $V_{hp}$ a substantial amount (even though no speed error existed). The large pressure error, with saturation of the control element $V_2$ and an extremely high value of the signal $E_p$, would therefore create a severe speed error transient.

In accordance with the present invention, the system exemplified in FIGS. 1 and 2 is improved by the incorporation of means to create a threshold signal which varies as a predetermined function of changes in one of the error function signals $E_s$ or $E_p$. Bounding means responsive to that threshold signal then serve to limit the other error function signal ($E_p$ or $E_s$) supplied by cross coupling to a combining amplifier ($A_3$ or $A_4$) to either (i) the value of the other function signal ($E_p$ or $E_s$) when it falls within the boundary defined by the threshold signal, or (ii) the threshold value itself when that other function signal ($E_p$ or $E_s$) violates or exceeds that boundary.

In an important aspect of the invention, the means for creating the threshold signal are constructed to make the threshold signal value at all times correspond to the value of the other error function signal which, under existing conditions, would cause one of the control elements just to reach the point of saturation or limiting (in a maximum and/or minimum sense).

This will be better understood from the more detailed description which follows with reference to FIG. 3 wherein one embodiment of the invention is illustrated and like reference characters are employed to identify like components as they have been described with reference to FIG. 2.

As a means to produce a threshold signal $T_{2u}$ which varies as a function of one error signal $E_s$, a summing amplifier 50 is responsive to the voltage $E_s$. Specifically, the voltage $E_s$ is applied to excite a potentiometer 51 to produce on its adjusted wiper a voltage $K_4 E_s$ which is fed via an input resistor $R_{5a}$ to the inverting input of a summing operational amplifier $A_5$. A constant (but preselectable) voltage $K_7$ is obtained from a potentiometer 52 (energized from a suitable B+ source) for application through an input resistor $R_{5b}$ to that same inverting input. The output of the amplifier $A_5$, having a feedback resistor $R_{5f}$, is thus:

$$-K_4 E_s - K_7$$

This output from amplifier $A_5$ is fed via an input resistor $R_{6a}$ which has a feedback resistor $R_{6f}$. Assuming for the moment that the various resistors are chosen in value such that:

$$\frac{R_{5f}}{R_{5a}} = 1; \frac{R_{5f}}{R_{5b}} = 1; \frac{R_{6f}}{R_{6a}} = \frac{1}{K_5} \tag{7}$$

then the threshold signal $T_{2u}$ varies with the voltage $E_s$ according to the function:

$$T_{2u} = \frac{K_4 E_s + K_7}{K_5} \tag{8}$$

This represents the upper boundary to which other error function signal $E_p$ should be restricted.

Let it be assumed that when the command signal $C_2$ falls to a known low value $C_{2L}$ which is readily ascertainable, the control element $V_2$ just reaches its minimum saturation point (here defined by way of example by the stop 25a in FIG. 1). Such known value $C_{2L}$ of the signal $C_2$ is reached, according to Equation (5) when:

$$C_{2L} = K_4 E_s - K_5 E_p + K_6 \quad (9)$$

For any value of the signal $E_s$, the particular value of the signal $E_p$ which will just cause lower limit saturation of the element $V_2$ is:

$$\text{sat. point } E_p = \frac{K_4 E_s + (K_6 - C_{2L})}{K_5} \quad (9a)$$

If by adjustment of the potentiometer 52 one chooses the constant $K_7$ in Equation (8) such that:

$$K_7 = K_6 - C_{2L} \quad (10)$$

then Equation (8) becomes:

$$T_{2u} = \frac{K_4 E_s + (K_6 - C_{2L})}{K_5} \quad (8a)$$

Since the threshold $T_{2u}$ varies according to Equation (8a), comparison with Equation (9a) confirms that signal $T_{2u}$ represents the value of the signal $E_p$, for any value of the signal $E_s$, at which the lower (minimum opening) saturation point of the control element $V_2$ will occur. If the signal $E_p$ rises above the threshold $T_{2u}$, the signal $C_2$ will fall below $C_{2L}$ and the element $V_2$ simply produces no corresponding response due to its minimum opening limit or saturation.

To alleviate the problem of the control element $V_2$ saturating in a maximum sense (i.e., the system calling for the valve $V_{Lp}$ to open wider than its maximum possible opening defined by the exemplary stop 25b), a second threshold signal $T_{2L}$ is created as a function of the error signal $E_s$. For this purpose, a second summing amplifier 55 is responsive to the error function signal $E_s$. As here shown, that latter voltage $E_s$ is applied to a potentiometer 56 adjusted to produce on its wiper a voltage $K_4 E_s$ which is applied through an input resistor $R_{7a}$ to the inverting input of an operational amplifier $A_7$. Further, a constant (but selectable) voltage representing an offset value $K_8$ is picked off of a potentiometer 58 (which is energized from a suitable B+ source) for application through an input resistor $R_{7b}$ to the same inverting input. With a feedback resistor $R_{7f}$, the output of amplifier $A_7$ is the inverted sum of the signals $K_4 E_s$ and $K_8$. For re-inversion, the latter output is transmitted through an input resistor $R_{8a}$ to the inverting input of an operational amplifier $A_8$ having a feedback resistor $R_{8f}$. The output of the latter is a variable lower threshold signal $T_{2L}$.

Assuming that the various resistor values are chosen such that:

$$\frac{R_{7f}}{R_{7a}} = 1; \frac{R_{7f}}{R_{7b}} = 1; \frac{R_{8f}}{R_{8a}} = \frac{1}{K_5} \quad (11)$$

then the output threshold signal $T_{2L}$ varies with the voltage $E_s$ according to the predetermined function:

$$T_{2L} = \frac{K_4 E_s + K_8}{K_5} \quad (12)$$

This represents the minimum boundary to which the other error function signal ($E_p$) should be restricted.

Let it be assumed that when the signal $C_2$ rises to known high value $C_{2u}$, then the control element $V_2$ just reaches its maximum limit or saturation point (exemplified by the stop 25b in FIG. 1). Such value $C_{2u}$ is readily ascertainable. During operation of the control system, it is reached according to Equation (5), when $E_s$ and $E_p$ take on values which satisfy:

$$C_{2u} = K_4 E_s - K_5 E_p + K_6 \quad (13)$$

For any value of the signal $E_s$, the value of the signal $E_p$ which will just cause upper limit saturation of the element $V_2$ is:

$$\text{sat. point } E_p = \frac{K_4 E_s + (K_6 - C_{2u})}{K_5} \quad (13a)$$

By adjustment of the potentiometer 58, the constant voltage $K_8$ appearing in Equation (12) is made such that:

$$K_8 = (K_6 - C_{2u}) \quad (14)$$

Equation (12) then becomes:

$$T_{2L} = \frac{K_4 E_s + K_6 - C_{2u}}{K_5} \quad (12a)$$

Since the lower threshold signal $T_{2L}$ varies according to Equation (12a)—compare Equation (13a)—it represents the value of the error function signal $E_p$ which, for any value of the error signal $E_s$, will cause the control element $V_2$ just to reach its maximum saturation or limit point. If the signal $E_p$ falls below the threshold $T_{2L}$, then the control element $V_2$ will try to open beyond its maximum limit but can produce no such response due to saturation.

Generically, either of the signals $T_{2u}$ or $T_{2L}$ represents a threshold value $T_2$ defining a boundary for the error function signal $E_p$ which, when reached and at any value of the signal $E_s$, will make the command signal $C_2$ have a limit or saturation value $C_{2s}$. Symbol $C_{2s}$ thus generically represents the two saturation point values designated $C_{2L}$ or $C_{2u}$ above. If the error function signal $E_p$ goes beyond the boundary value (rises above $T_{2u}$ or falls below $T_{2L}$) then the control element $V_2$ cannot respond further and is in a saturated condition (either minimum or maximum opening of the valve $V_{Lp}$).

Figure 3A:
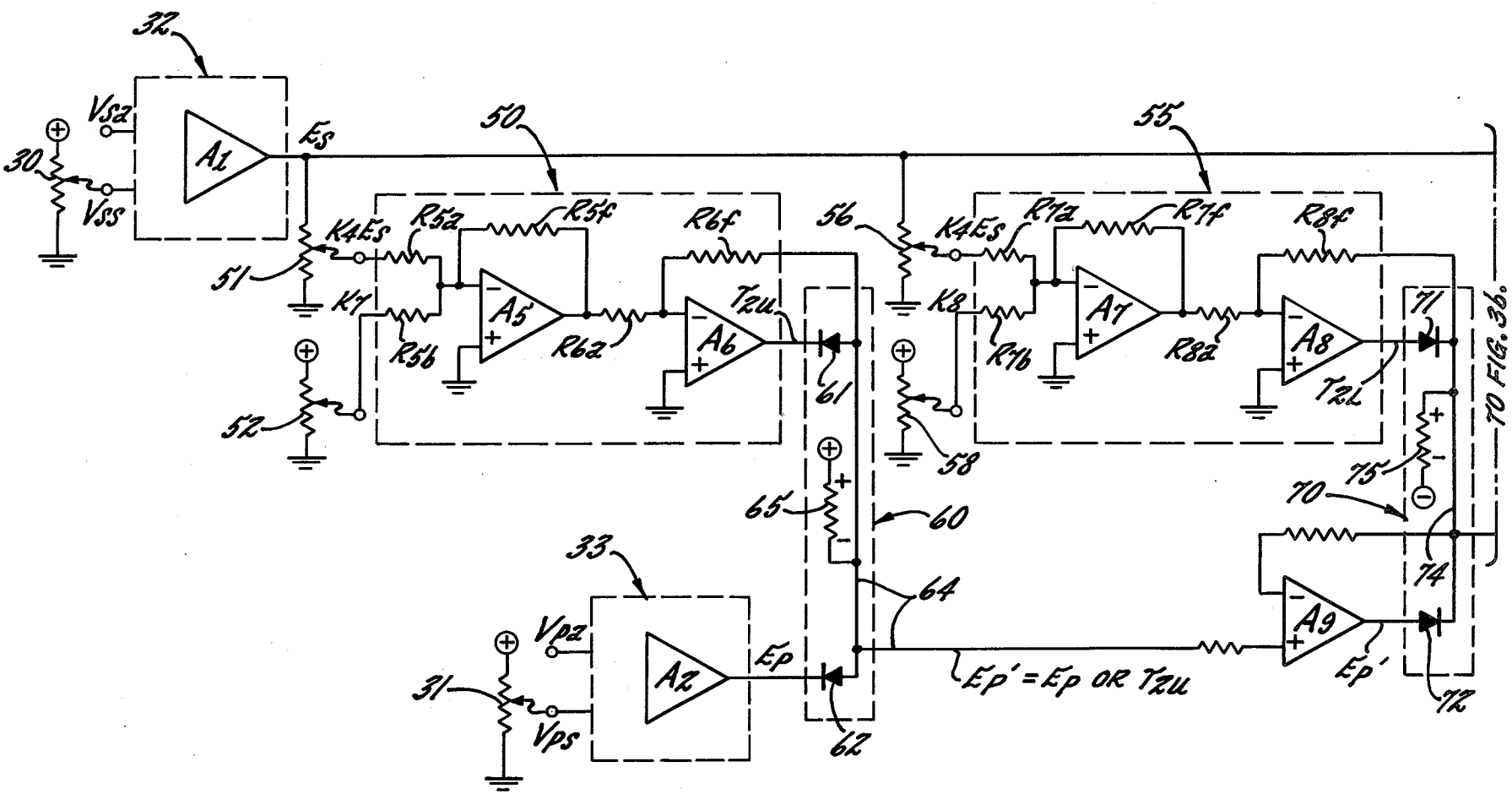
FIGS. 3*a* and 3*b*, when joined, form a single figure (herein called FIG. 3) showing a block diagram, partially in schematic circuit form, which illustrates an exemplary embodiment of the present invention, specifically improvements to the prior art system of FIG. 2 for enhancing control performance by alleviating the magnitude and duration of error transients under certain conditions.
Figure 3B:
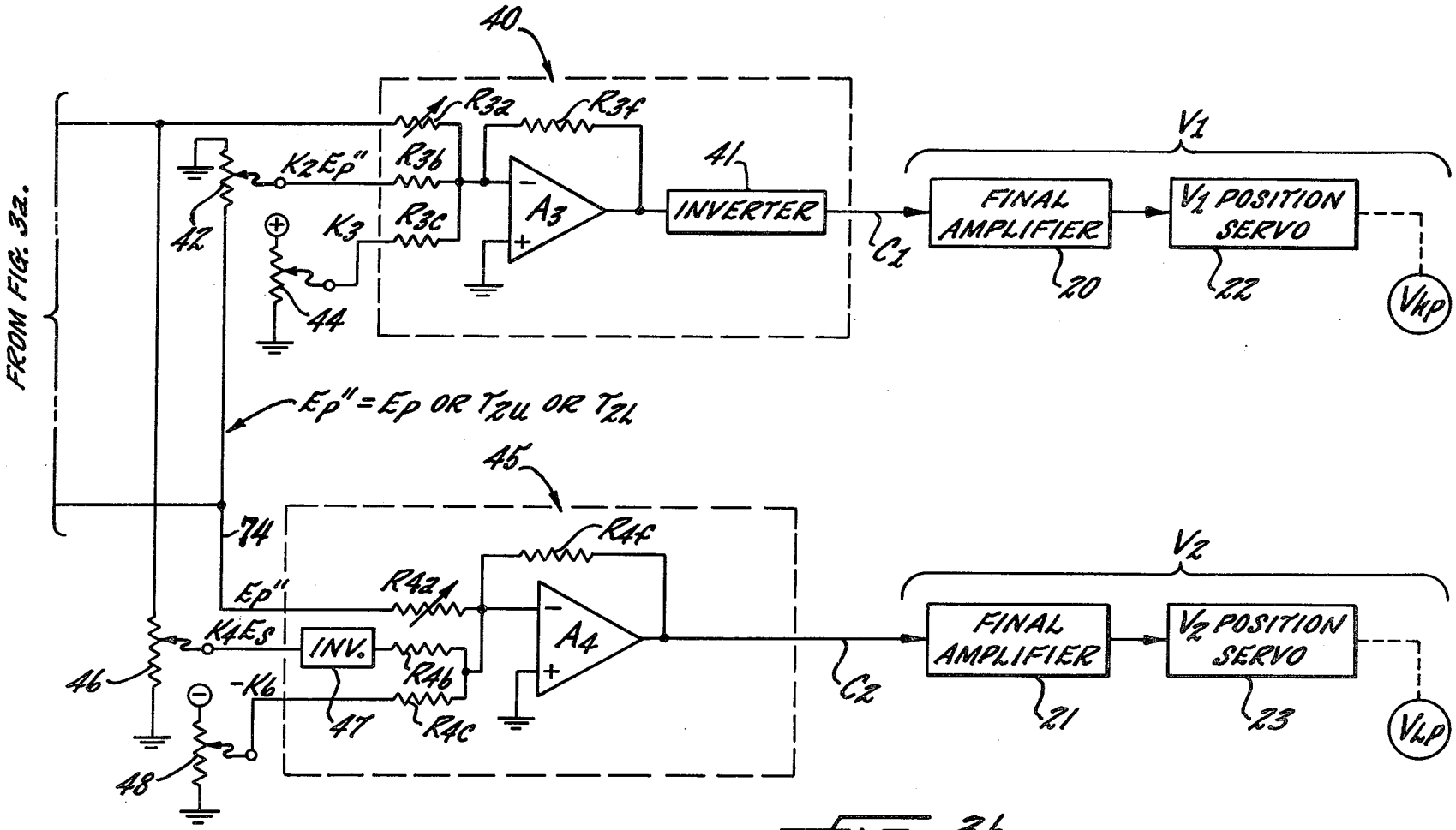

To complete the invention in the specific embodiment of FIG. 3, means are provided to limit the effectively used error function signal $E_p$ to a value which does not violate the boundary defined by the threshold signal $T_2$. Since both upper and lower threshold signals $T_{2u}$ and $T_{2L}$ are formed in FIG. 3, two bounding means are employed.

Although other bounding circuits may be used, the signals $T_{2u}$ and $E_p$ are applied to a "least signal selector" (LSS) 60 formed by two diodes 61 and 62 having (a) their cathodes connected respectively to the outputs of amplifiers $A_6$ and $A_2$, and (b) their anodes connected by a conductor 64 to a resistor 65 leading to a suitable B+ voltage source. In essence, the LSS circuit 60 passes to the conductor 64 a signal designated $E'_p$ which is the smallest of the two inputs $E_p$ and $T_{2u}$, where "smallest" means the least positive or greatest negative. The diodes 61, 62 may be viewed ideally for purposes of discussion as switches which are open when reversely biased and closed when forwardly biased. Thus, if the voltage $E_p$ is less than the voltage $T_{2u}$, the diode 62 is conductive to draw current through resistor 65, and the resulting voltage drop across that resistor (with theoretically zero voltage drop across diode 62) makes the conductor 64 reside at a voltage $E'_p$ equal to the signal $E_p$. This also reversely biases the diode 61 so that it is nonconductive and therefore the signal $T_{2u}$ has no affect on the voltage which appears at conductor 64. Conversely, if the signal $T_{2u}$ is less than the voltage $E_p$, the diode 61 will be conductive to draw current through the resistor 65 (and the diode 62 will be non-conductive) so that the signal $E'_p$ appearing on conductor 64 is equal to the signal $T_{2u}$. It is appropriate to designate, therefore, that the signal appearing on conductor 64 at any time is:

$$E'_p = E_p \text{ if } E_p < T_{2u} \quad (15)$$
$$E'_p = T_{2u} \text{ if } E_p > T_{2u} \quad (15a)$$

As a second bounding means, a "greatest signal selector" (GSS) circuit 70 receives as its inputs the signals $E'_p$ and $T_{2L}$. A non-inverting, unity gain buffer amplifier $A_9$ is employed to feed the signal $E'_p$ from conductor 64 to the input of GSS circuit 70. That selector circuit is formed by two diodes 71 and 72 having (a) their anodes connected respectively to the outputs of amplifiers $A_9$ and $A_8$, and (b) their cathodes connected to a common conductor 74 leading through a resistor 75 to a suitable B− voltage source. In essence, the GSS circuit passes to the conductor 74 the greatest of the two inputs $E'_p$ and $T_{2L}$, where "greatest" means the most positive or least negative. The operation of the GSS circuit 70 will be readily understandable from the previous description of the LSS circuit 60. The diodes 71 and 72 may be viewed as ideal for purposes of discussion, i.e., as switches which are open when reversely biased and closed when forwardly biased. If the signal $E'_p$ is greater than the signal $T_{2L}$, then diode 72 is conductive to send current through resistor 75, thereby reversely biasing diode 71 and making the voltage on conductor 74 equal to the signal $E'_p$. Conversely, if the signal $T_{2L}$ is greater than the signal $E'_p$, the former signal appears on the conductor 74. If one designates the signal on conductor 74 as $E''_p$, then it becomes apparent that:

$$E''_p = E_p, \text{ if } T_{2L} < E_p < T_{2u} \quad (16)$$
$$E''_p = T_{2u}, \text{ if } E_p > T_{2u} \quad (16a)$$
$$E''_p = T_{2L}, \text{ if } E_p < T_{2L} \quad (16b)$$

It is to be remembered that the constant upper saturation point $C_{2u}$ is by definition greater than the constant lower saturation point $C_{2L}$, so from Equations (12a) and (8a) it follows that $T_{2u}$ is always greater than $T_{2L}$.

In FIG. 3, the signal $E''_p$ is fed to the potentiometer 42 where it takes the place of the signal $E_p$ as illustrated in FIG. 2. That is, the potentiometer 42 and combining amplifier $A_3$ receive the signal $E_p$ if the latter does not go beyond either an upper or lower boundary which represents the saturation point of the control element $V_2$. On the other hand, if the signal $E_p$ exceeds either the upper or lower boundary which represents a minimum or maximum saturation point for the control element $V_2$, the signal $E''_p$ applied to the potentiometer 42 is restricted or bounded to the threshold value $T_{2u}$ or $T_{2L}$. The signal $K_2 E''_p$ is correspondingly bounded. This means that when a severe error transient in the controlled variable P for any reason arises, and the control element $V_2$ tries, but cannot, act beyond a saturation point (either minimum or maximum opening), the cross-coupled signal based on the error signal $E_p$ cannot vary to such an extent that the amplifier $A_3$ changes the command signal $C_1$ by such a wide margin as to severely change the controlled variable S from its set point value. In other words, by establishing variable boundaries for the signal $E_p$ which is applied to the combining amplifier $A_3$ as the bounded signal $E''_p$, undue "fighting" between the two control elements $V_1$ and $V_2$ is alleviated, and major transients in the controlled speed S are avoided even if severe transients in the controlled variable P arise.

In FIG. 3, the bounded signal $E''_p$ (bounded so that it can vary only below the threshold $T_{2u}$ or above the threshold $T_{2L}$) is also applied to the input resistor $R_{4a}$ of combining amplifier $A_4$—in lieu of the signal $E_p$ as shown in FIG. 2. As a result, the signal $C_2$ cannot rise above or fall below its upper and lower saturation point values $C_{2u}$ and $C_{2L}$. Nevertheless, the signal $E_p$ in FIG. 3 could be applied directly to the input resistor $R_{4a}$ with equal effect since even without bounding of its value, the final control element $V_2$ can do no more than to have its maximum or minimum effect on speed S and pressure P. Thus, the key advantage of the present invention resides in applying the bounded signal $E''_p$ to the potentiometer 42 (and to combining amplifier $A_3$) so as to avoid extreme swings in the signal $C_1$ when the signal $E_p$ goes beyond a level (either $T_{2u}$ or $T_{2L}$) at which the control element $V_2$ saturates and can exert no additional controlling effect.

Figure 4:
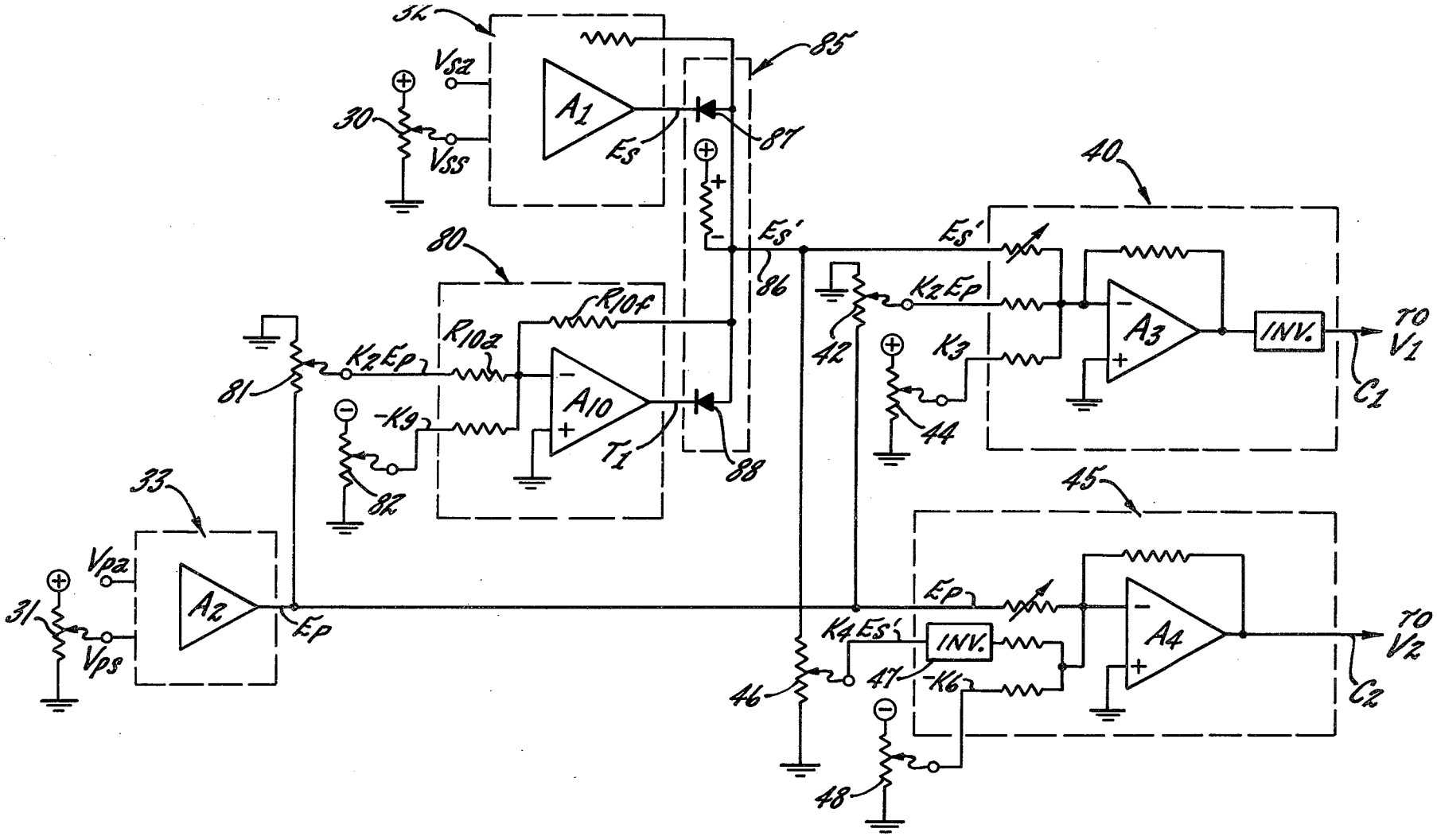
FIG. 4 is similar to FIG. 3 but illustrates a second embodiment of the invention as applied to reduce the adverse effect of the high pressure steam valve being driven to a limited or saturated status.

FIG. 4 illustrates a second embodiment of the invention applied as an improvement to the basic system of FIGS. 1 and 2. In this instance it is contemplated that the user of a system may, on various occasions, wish to adjust the speed set point to such a high value that the control element $V_1$ and its valve $V_{hp}$ are driven to a wide open position to obtain the maximum power from the first turbine stage **10*a*,** while nevertheless controlling the extraction pressure P at some set point value. In these circumstances, the signal $E_s$ may become larger than required to make the signal $C_1$ drive control element $V_1$ to its maximum saturation point (with valve $V_{hp}$ at maximum opening), and the cross coupled signal $K_4 E_s$ fed to the combining amplifier $A_4$ would be so large as to keep the valve $V_{Lp}$ open (even despite a large pressure error signal $E_p$) beyond the point where pressure P is maintained essentially at its set point.

To guard against this difficulty, a threshold signal $T_1$ is created by means responsive to one of the error function signals, namely, $E_p$—such threshold signal varying as a predetermined function of that error signal $E_p$. Secondly, the error signal effectively cross coupled to the amplifier $A_4$ via potentiometer 46 is made (i) equal to the primary error signal $E_s$ when $E_s$ is within the boundary defined by the threshold $T_1$, or (ii) equal to the threshold value when $E_s$ is outside of that defined boundary.

For this purpose, the embodiment of FIG. 4 includes means in the form of a summing amplifier 80 receiving the signal $E_p$ and creating a threshold signal $T_1$. As shown, the signal $E_p$ is injected via a potentiometer 81 which is adjusted to establish the desired multiplier constant $K_2$; the resulting signal $K_2 E_p$ is fed via a resistor $R_{10a}$ to the inverting input of an operational amplifier $A_{10}$. A second, constant (but adjustable) voltage $-K_9$ is fed to the inverting input of that amplifier via a resistor $R_{10b}$ from a potentiometer 82 excited from a suitable B-source voltage. With a feedback resistor $R_{10f}$, the amplifier is conditioned to make its output or threshold signal $T_1$ vary to have a value which corresponds, for any value of the error signal $E_p$, to the saturation point of the signal $C_1$ fed to the control element $V_1$.

To accomplish this, the resistors are chosen in value such that:

$$\frac{R_{10f}}{R_{10a}} = \frac{1}{K_1}; \quad \frac{R_{10f}}{R_{10b}} = \frac{1}{K_1} \tag{17}$$

The output signal $T_1$ thus varies according to the expression:

$$T_1 \frac{K_9 = K_2 E_p}{K_1} \tag{18}$$

When the control element $V_1$ just reaches maximum saturation (valve $V_{hp}$ just hits stop 24a) the requisite value of the command signal $C_1$ has a saturation point value $C_{1s}$ which is a known constant. Such saturation point value $C_{1s}$ will be reached, according to Equation (2) when $E_s$ and $E_p$ have values which satisfy:

$$C_{1s} = K_1 E_s + K_2 E_p + K_3 \tag{19}$$

For any value of the signal $E_p$, the saturation point is thus reached when $E_s$ has the value:

$$\text{sat. point } E_s = \frac{(C_{1s} - K_3) - K_2 E_p}{K_1} \tag{19a}$$

The potentiometer 82 is adjusted to make the constant voltage signal $K_9$ have a value:

$$-K_9 = -(C_{1s} - K_3) \tag{20}$$

Equation (18) then becomes:

$$T_1 = \frac{(C_{1s} - K_3) - K_2 E_p}{K_1} \tag{18a}$$

Thus, the threshold signal $T_1$ represents at all times the value of the signal $E_s$ which would cause the signal $C_1$ to have its saturation point value $C_{1s}$ if it were applied to the combining amplifier $A_3$.

To supply the potentiometer 46 with an excitation signal equal to the lesser of (a) the threshold $T_1$, or (b) the error signal $E_s$, a least signal selector circuit 85 receives those two signals and produces an output $E'_s$ on a common conductor 86.

The LSS circuit 85 is made up of diodes 87 and 88, and functions in the same way as the LSS circuit 60 shown in FIG. 3. Thus, the bounded signal $E'_s$ which appears on conductor 86 takes on different possible values, viz:

$$E'_s = E_s \text{ if } E_s < T_1 \tag{21a}$$
$$E'_s = T_1 \text{ if } E_s > T_1 \tag{21b}$$

When, for example, the set point voltage $V_{ss}$ is made so high as to increase the signal $E_s$ sufficiently to purposely run the valve $V_{hp}$ wide open,—and even if the error signal $E_s$ exceeds the level at which the control element $V_1$ saturates—, the combining amplifier $A_4$ receives an input signal $K_4 E'_s$ (via potentiometer 46) which appears as if the element $V_1$ were just at the beginning point of saturation. This prevents the command signal $C_2$ from increasing to such a degree that the control element $V_2$ attempts to drive valve $V_{Lp}$ fully open with a consequent pressure error transient or loss of control over the controlled pressure P.

The improved system of FIG. 4 does not include any means to place a lower boundary on the signal $E'_s$ (in the fashion that the signal $E_p$ is effectively bounded at both $T_{2u}$ and $T_{2L}$ in FIG. 3). While such a lower boundary could be imposed in FIG. 4 in a parallel manner to that explained in FIG. 3, the control element $V_1$ will be generally set up such that the minimum open limit position of the valve $V_{hp}$ is its fully closed position. This being so, all steam flow will be shut off if the control element $V_1$ saturates in a minimum direction; and thus it becomes fruitless to attempt to maintain the pressure P at its set point value.

It will be apparent that the improvement of FIG. 4 may be added into the improved system of FIG. 3 so that the signal $E_p$ is in effect bounded at upper and lower values and the signal $E_s$ is bounded at an upper value. Indeed, the invention may be applied to advantage in a two-variable control system by either (i) putting a lower boundary on one error function signal, (ii) putting an upper boundary on one error function signal, (iii) putting both an upper and a lower boundary on one error function signal, (iv) putting an upper and a lower boundary on both error function signals, or (v) putting an upper and a lower boundary on one error function signal and one boundary (either upper or lower) on the other error function signal.

Various departures from the specific apparatus shown in FIGS. 3 and 4 may be adopted while nevertheless practicing the present invention to obtain the advantages thereof. For example, in FIG. 3 three potentiometers 46, 51, 56 all receive the same signal $E_s$ and are adjusted to provide the same multiplier $K_4$ to produce a signal $K_4 E_s$. A single such potentiometer could be used to supply a single voltage $K_4 E_s$ to all three points in the circuitry. Secondly, while various arrangements for operational amplifiers are here shown to produce signals which vary as the algebraic sums of plural inputs and with adjustable, preselected values of various constants, other specific amplifier or signal processing arrangements for accomplishing the same operations will occur to those skilled in the art. Further, some or all signal polarities here shown may be reversed; so long as the reversals or inversions are of an even number, the operation will be the same. Indeed, the sense of action of the final control elements may be reversed (e.g., $V_1$ and $V_2$ may be made to act to close valves $V_{hp}$ and $V_{Lp}$ when signal $E_s$ increases), if signal variations at other points are appropriately reversed or inverted. Further, the improvement here brought forth may be embodied in control apparatus in other than that here shown as producing and utilizing variable dc. voltage signals. The various signals may be in other forms such as pneumatic pressure, hydraulic pressure or mechanical position variations. Indeed, such signals may be multibit digital signals which are sensed, created and utilized on a rapidly iterated time basis. Finally, the system to be controlled may be one in which more than two variables are simultaneously controlled—such for example as a steam turbine having more than two stages with more than one controlled extraction pressure. The invention may be extended, essentially by duplication of the apparatus here described for controlling two variables, to the simultaneous control of a larger plurality of variables.

I claim:

1. In a system for controlling first and second variables (S and P) by variably exciting first and second control elements ($V_1$ and $V_2$), said first element ($V_1$) directly affecting both variables as its excitation is increased or decreased, and said second element ($V_2$) directly affecting one variable but oppositely affecting the other variable, said system including:

a. means for creating a first error function signal ($E_s$) which varies according to the error between set point and actual values of one controlled variable, b. means for creating a second error function signal ($E_p$) which varies according to the error between set point and actual values of the other controlled variable, c. means for combining said first and second error function signals to create a first command signal ($C_1$) which varies with a cumulative effect of changes in such function signals, d. means for combining said first and second error function signals to create a second command signal ($C_2$) which varies with a differential or opposite effect of changes in the respective function signals, e. means for exciting the first control element ($V_1$) with said first command signal to increase or decrease said two variables, and f. means for exciting the second control element ($V_2$) with said second command signal, thereby to increase or decrease one of said variables while respectively decreasing or increasing the other variable, the improvement which comprises g. means responsive to one of said error function signals ($E_s$ or $E_p$) for creating a threshold signal (T) which varies as a predetermined function of such one signal, and h. means for supplying to one of said means (c) or said means (d) either (i) the other of the function signals ($E_p$ or $E_s$) or, in lieu thereof, (ii) said threshold signal, —whenever said other function signal lies respectively (i) within or (ii) without a boundary represented by the magnitude of the threshold signal.

2. The improved system set forth in claim 1 wherein one of said control elements ($V_1$ or $V_2$) has a physical limit of response and produces no effect upon the controlled variables even though the corresponding one command signal ($C_1$ or $C_2$) applied thereto varies beyond a predetermined saturation point ($C_s$) and further characterized in that said means (g) includes:

81. means for creating said threshold signal with a value which, when combined in the means (c) or (d) to create said one command signal ($C_1$ or $C_2$) makes the said one command signal take on said predetermined saturation point.

3. The improved system set forth in claim 2 wherein said physical limit of response of said one control element is the maximum extent of the influence which the control element can exert to increase the variable or variables directly affected thereby, and said predetermined saturation point is the maximum value of said one command signal to which said one control element responds.

4. The improved system set forth in claim 2 wherein said physical limit of response of said one control element is the minimum extent of the influence which the control element can exert in an increasing sense on the variable or variables directly affected thereby, and said predetermined saturation point is the minimum value of said one command signal to which said one control element responds.

5. The improved system set forth in claim 1 further characterized in that said means (g) includes:

g1. means responsive to one of said error function signals for creating upper and lower threshold signals which vary as respective predetermined functions of such one signal, and said means (h) includes h1. means for supplying to said one of means (c) or said means (d) either:

i. the other of said error function signals, ii. said upper threshold signal, or iii. said lower threshold signal respectively when said other function signal:

i. is in value intermediate the values of the upper and lower threshold signal, ii. is in value greater than the value of the upper threshold signal, or iii. is in value less than the value of the lower threshold signal.

6. The improved system set forth in claim 1, further characterized in that:

f1. said means (f) constitutes means for exciting said second control element with said second command signal to cause said first variable to increase when the first error function signal increases, and to cause said second variable to increase when the second error function signal increases, g1. said means (g) constitutes means responsive to said first error function signal ($E_s$) to make said threshold signal vary as a predetermined function of such function signal, and h1. said means (h) constitutes means for supplying to said means (c) the second function signal ($E_p$) while preventing the signal so supplied from going beyond a boundary which is the then-existing value of said threshold signal.

7. The improved system set forth in claim 1 further characterized in that:

g1. said means (g) constitutes means responsive to said second error function signal ($E_p$) to make said threshold signal vary as a predetermined function of such signal, and h1. said means (h) constitutes means for supplying to means (d) the first error function signal ($E_s$) while preventing the signal so supplied from going beyond a boundary which is the then-existing value of said threshold signal.

8. The improved system defined by claim 6, further characterized in that:

c1. said means (c) constitutes a means for creating said first command signal $C_1$ substantially according to the relationship $$C_1 = K_1 E_s + K_2 E_p + K_3$$

where the K's are preselected constants and $E_s$ and $E_p$ represent the values of said first and second error function signals, d1. said means (d) constitutes a means for creating said second command signal $C_2$ according substantially to the relationship $$C_2 = K_4 E_5 - K_5 E_p + K_6$$

where the $K$'s are preselected constants and $E_s$ and $E_p$ represent the values of said first and second error function signals, g2. said means (g1) constitutes a means responsive to said first error function signal ($E_s$) to create said threshold signal $T_2$ substantially according to the relationship $$T_2 = \frac{K_4 E_s + K_6 - C_{2s}}{K_5}$$

where $C_{2s}$ represents the maximum or the minimum saturation value of the command signal $C_2$ to which said second control element effectively responds, and h2. said means (h1) constitutes means for supplying as an input to said means (c) either (i) said second function signal $E_p$ or, when the latter signal exceeds the boundary represented by the threshold signal $T_2$, the threshold signal value.

9. The improved system defined by claim 7, further characterized in that:

c1. said means (c) constitutes a means for creating said first command signal $C_1$ substantially according to the relationship $$C_1 = K_1 E_s + K_2 E_p + K_3$$

where the $K$'s are preselected constants and $E_s$ and $E_p$ represent the values of said first and second error function signals, $$C_2 = K_4 E_s - K_5 E_p + K_6$$

where the $K$'s are preselected constants and $E_s$ and $E_p$ represent the values of said first and second error function signals, g2. said means (g1) constitutes a means responsive to said second error function signal ($E_p$) to create said threshold signal $T_1$ substantially according to the relationship $$T_1 = \frac{C_{1s} - K_3 - K_2 E_p}{K_1}$$

where $C_{1s}$ represents the maximum or minimum saturation value of the command signal $C_1$ to which said first control element effectively responds, and h2. said means (h1) constitutes means for supplying as an input to said means (d) either (i) said first function signal $E_s$ or, when the latter exceeds the boundary represented by the threshold signal $T_1$, the threshold signal value.

10. The improved system defined by claim 8 further characterized in that:

g3. said means (g2) constitutes a means for producing said threshold signal $T_2$ as a lower threshold $T_{2L}$ according to the recited relationship, where $C_{2s}$ represents the maximum saturation value $C_{2u}$ of the command signal $C_2$ to which said second control element effectively responds, g4. said system includes a means responsive to said first function error signal ($E_s$) to create an upper threshold signal $T_{2u}$ substantially according to the relationship $$T_{2u} = \frac{K_4 E_s + K_6 - C_{2L}}{K_5}$$

where $C_{2L}$ represents the minimum saturation value of the command signal $C_2$ to which said second control element effectively responds, and h3. said means (h2) constitutes a means for supplying as an input to said means (c) either:

i. the signal $E_p$ when $T_{2L} < E_p < T_{2u}$, or ii. the signal $T_{2L}$ when $E_p < T_{2L}$, iii. the signal $T_{2u}$ when $E_p < T_{2u}$.

11. In a system for controlling first and second variables $S$ and $P$ by variably exciting first and second control elements $V_1$ and $V_2$, said first element $V_1$ directly affecting both variables as its excitation is increased or decreased, and said second element $V_2$ directly affecting the first variable S and oppositely affecting the second variable $P$ as its excitation is increased or decreased, said system including:

a. means for producing a first error function signal $E_s$ which varies according to the error between set point and actual values of the first variable $S$, b. means for producing a second error function signal $E_p$ which varies according to the error between set point and actual values of the second variable P, c. means receiving said first and second error function signals $E_s$ and $E_p$ for producing a first command signal $C_1$ which varies as an additive function $C_1 = f(E_s + E_p)$ of its inputs, d. means receiving said first and second signals $E_s$ and $E_p$ for producing a second command signal $C_2$ which varies as a substractive function $C_2 = f(E_s - E_p)$ of its inputs, e. means for exciting said first control element $V_1$ with said first command signal $C_1$ to cause increase or decrease of said variables $S$ and $P$ as such signal increases or decreases, and f. means for exciting said second control element $V_2$ with said second command signal $C_2$ to cause said first variable $S$ to increase or decrease, and said second variable $P$ to decrease or increase, as such signal respectively increases or decreases, the improvement which comprises g. means responsive to one of said error function signals ($E_s$ or $E_p$) for creating a threshold signal $T$ which varies as a predetermined function of such one signal, and h. means for bounding the variations of the other error function signal ($E_p$ or $E_s$), before it is fed to said means (c) or (d), at a limit value equal to the then-existing value of the threshold signal $T$.

12. The improved system set out in claim 11 further characterized in that one of said control elements ($V_2$ or $V_1$) is physically limited and lacks response to its excitation signal ($C_2$ or $C_1$) rising above or falling below saturation values ($C_{2u}$, $C_{2L}$, or $C_{1u}$, $C_{1L}$), and wherein g1. said means (g) constitutes means for making said threshold signal T vary with said one error function signal ($E_s$ or $E_p$) to take on values which —when combined in one of said means (c) or (d) with the other error function signal ($E_p$ or $E_s$)— causes the resultant excitation signal ($C_2$ or $C_1$) to have one of its saturation values ($C_{2u}$ or $C_{2L}$, OR $C_{1u}$ or $C_{1L}$), whereby the other of said control elements ($V_1$ or $V_2$) is prevented from producing major transient disturbances in consequence of said other error function signal ($E_p$ or $E_s$) passing through said limit value.

13. The improved system set out in claim 11 further characterized in that g1. said means (g) constitutes means responsive to one of said error function signals ($E_s$ or $E_p$) for creating lower and upper threshold signals $T_L$ and $T_u$ which vary as respective predetermined functions of such one signal, and h1. said means (h) constitutes means for bounding the variations of the other error function signal ($E_p$ or $E_s$), before it is fed to said means (c) or (d), between limit values equal to the then existing values of the lower and upper threshold signals.

14. The improved system set out in claim 11 further characterized in that:

c1. said additive function is substantially of the form $$C_1 = K_1 E_s + K_2 E_p + K_3$$

where the $K$'s are preselected constants d1. said subtractive function is substantially of the form $$C_2 = K_4 E_s - K_5 E_p + K_6$$

where the $K$'s are preselected constants, g1. said means (g) constitutes means for creating said threshold signal $T$ with a predetermined function substantially of the form $$T_2 = \frac{K_4 E_s + K_6 - C_{2s}}{K_5}$$

where $C_{2s}$ is an upper or lower saturation value of the second command signal $C_2$ beyond which said second control element ($V_2$) will not respond, and h1. said means (h) constitutes means for bounding the variations of said other error function signal ($E_p$), before it is fed to said means (c), at a limit value equal to the then-existing value of the threshold signal $T_2$.

* * * * *